US009930726B2

(12) United States Patent
Maruyama et al.

(10) Patent No.: US 9,930,726 B2
(45) Date of Patent: Mar. 27, 2018

(54) HEATING DEVICE AND HEATING METHOD

(71) Applicant: TOYO SEIKAN GROUP HOLDINGS, LTD., Tokyo (JP)

(72) Inventors: Tomoki Maruyama, Yokohama (JP); Shinji Yamada, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 497 days.

(21) Appl. No.: 14/408,329

(22) PCT Filed: Jul. 1, 2013

(86) PCT No.: PCT/JP2013/068004

§ 371 (c)(1),
(2) Date: Dec. 16, 2014

(87) PCT Pub. No.: WO2014/010449

PCT Pub. Date: Jan. 16, 2014

(65) Prior Publication Data

US 2015/0189696 A1 Jul. 2, 2015

(30) Foreign Application Priority Data

Jul. 9, 2012 (JP) ..... 2012-153665

(51) Int. Cl.
*H05B 3/08* (2006.01)
*H05B 3/00* (2006.01)
(Continued)

(52) U.S. Cl.
CPC ..... *H05B 3/0004* (2013.01); *H05B 3/023* (2013.01); *H05B 3/03* (2013.01)

(58) Field of Classification Search
CPC ..... H05B 3/03; H05B 3/0004; H05B 3/023; H05B 3/06; H05B 7/185; H05B 2203/003;
(Continued)

(56) References Cited

U.S. PATENT DOCUMENTS

2010/0326982 A1 12/2010 Yamada et al.

FOREIGN PATENT DOCUMENTS

EP 2175693 A1 * 4/2010 ..... A23L 3/10
JP 10262625 A * 10/1998
(Continued)

OTHER PUBLICATIONS

International Search Report dated Jul. 23, 2013 issued in corresponding application No. PCT/JP2013/068004.

*Primary Examiner* — Hung D Nguyen
(74) *Attorney, Agent, or Firm* — Westerman, Hattori, Daniels & Adrian, LLP

(57) ABSTRACT

A heating device and a heating method are disclosed, by which an irregularly shaped object can be evenly and efficiently heated by a plurality of conductive pins smoothly sliding inside through holes so that their tips sufficiently follow the irregular shape of the object, while damage to the conductive pins or the object is prevented. The heating device 100 heats an object M placed between opposing electrodes 101 and 102. At least one of the electrodes 101 includes a retention plate 130 for retaining a plurality of conductive pins 110 supported in an electrode plate 120 in a state in which the conductive pins 110 are slid away from an opposite electrode 102, and a release mechanism 140 for releasing the plurality of conductive pins 110 from retention by the retention plate 130.

4 Claims, 13 Drawing Sheets

(51) Int. Cl.
*H05B 3/03* (2006.01)
*H05B 3/02* (2006.01)

(58) Field of Classification Search
CPC .. H05B 6/62; H05B 6/54; B23K 1/008; A23L 3/10
USPC ..... 219/383, 541, 538, 388, 764
See application file for complete search history.

(56) References Cited

FOREIGN PATENT DOCUMENTS

| | | | | | |
|---|---|---|---|---|---|
| JP | 2000106854 | A | * | 4/2000 | |
| JP | 3352388 | B2 | * | 12/2002 | ..... H05B 3/0004 |
| JP | 2003-47413 | A | | 2/2003 | |
| JP | 2003047413 | A | * | 2/2003 | |
| JP | 2004349116 | A | * | 12/2004 | |
| JP | 2007-159413 | A | | 6/2007 | |
| JP | 2007159413 | A | * | 6/2007 | |
| JP | 3966888 | B2 | | 8/2007 | |
| JP | 2010-277766 | A | | 12/2010 | |
| JP | 2012-099263 | A | | 5/2012 | |
| WO | 2009/008421 | A1 | | 1/2009 | |

* cited by examiner

HEATING DEVICE AND HEATING METHOD

TECHNICAL FIELD

The present invention relates to a device for and a method of heating an object electrically by placing the object between, and applying voltage across, electrodes that are arranged opposite each other, at least one of the electrodes having an electrode plate with a plurality of through holes and a plurality of conductive pins axially slidably supported in the through holes.

BACKGROUND ART

Devices for and methods of electrically heating an object such as a food product by placing the object between opposing electrodes have hitherto been known, and various forms of electrodes used therefore are known.

For even and efficient heating, in devices that achieve heating by direct application of electrical energy, the electrodes need to make sufficient contact with the object being heated, and in devices that achieve induction heating by application of a high frequency electric field, gaps between the object and the electrodes need to be kept small and even.

In order to deal with irregularly shaped objects, there has been proposed a device in which at least one of the electrodes has an electrode plate with a plurality of through holes and a plurality of conductive pins axially slidably supported in the through holes (see, for example, Patent Documents 1 and 2).

With the use of an electrode having conductive pins that are axially slidably supported, even an irregularly shaped object can be evenly heated in a short time without local concentration of heat, as the conductive pins follow the irregular contour of the object and the tips of the plurality of conductive pins evenly make contact with the surface of the object.

PRIOR ART LITERATURE

Patent Documents

Patent Document 1: Japanese Patent No. 3966888
Patent Document 2: WO 2009/008421

SUMMARY OF THE INVENTION

Problems to be Solved by the Invention

The known electrodes described in Patent Documents 1 and 2 are configured to bring conductive pins 510 in an upper electrode 501 into contact with an object M by introducing the object M in a state in which the electrode plate 520 is in its lifted position so that the plurality of conductive pins 510 are all lowered by their own weight, as shown in FIG. 15, and by lowering the electrode plate 520, whereby tips 511 of the plurality of conductive pins 510 contact the irregularly shaped object M and stop there, following the irregular contour by axially sliding inside through holes 521.

However, when the tips of the conductive pins 510 make contact with an inclined portion of the irregular contour of the object M, a component of force is generated in a direction perpendicular to the sliding directions of the conductive pins 510 as shown in FIG. 16, because of which the conductive pins 510 are subjected to forces that cause them to incline inside the through holes 521 of the electrode plate 520, and made unable to slide smoothly.

When the conductive pins 510 stop inside the through holes 521, the electrode plate 520 also stops moving down, in which case the tips 511 of the plurality of conductive pins 510 cannot sufficiently follow the irregular shape of the object M, resulting in a problem that the object M cannot be heated evenly and efficiently.

There was also a possibility that the conductive pins 510 could be bent or broken, or movable parts for lowering the electrode plate 520 could be damaged due to an overload, and a possibility that the object such as a food product could be scarred or crushed due to a large load applied thereon.

The electrodes described in Patent Document 2 include a variable pressure gas chamber connected to the electrode plate 520, so that, theoretically, it is possible to move up the conductive pins 510 by drawing a negative pressure inside the gas chamber. To allow the conductive pins 510 to slide smoothly inside the through holes 521, however, the through holes need to have an inside diameter that is sufficiently larger than the outer shape of the conductive pins. This leads to an increase in the amount of gas leaking through clearances between conductive pins and through holes, thus making it realistically difficult to stably and reliably move up all of a multiplicity of conductive pins.

The present invention solves the problems described above, and its object is to provide a heating device and a heating method, whereby an irregularly shaped object can be evenly and efficiently heated with a plurality of conductive pins smoothly sliding inside through holes so that their tips can sufficiently follow the irregular shape of the object, while damage to the conductive pins or object is prevented.

Means for Solving the Problems

The invention according to item 1 is a heating device for electrically heating an object by placing the object between electrodes that are arranged opposite each other, at least one of the electrodes having an electrode plate with a plurality of through holes and a plurality of conductive pins axially slidably supported in the through holes, the at least one of the electrodes including: retention means for retaining the plurality of conductive pins supported in the electrode plate in a state in which the conductive pins are slid away from an opposite electrode; and release means for releasing the plurality of conductive pins from retention by the retention means, thereby to solve the problems mentioned above.

To solve the problems described above, in the invention according to item 2, in addition to the configuration of the heating device according to item 1, rear ends of the conductive pins are made from a magnetic member, and the retention means include a magnetic plate that is arranged parallel to the electrode plate and exerts an attractive magnetic force on the rear ends of the conductive pins.

To solve the problems described above, in the invention according to item 3, in addition to the configuration of the heating device according to item 2, a non-magnetic plate is provided between the rear ends of the conductive pins and the magnetic plate, and the release means include a mechanism for separating the non-magnetic plate from the magnetic plate.

The invention according to item 4 is a heating method that uses a heating device for electrically heating an object by placing the object between electrodes that are arranged opposite each other, at least one of the electrodes having an electrode plate with a plurality of through holes and a plurality of conductive pins axially slidably supported in the through holes, this method including: a conductive pin retraction step of sliding the plurality of conductive pins supported in the electrode plate away from an opposite electrode; a conductive pin retention step of retaining the conductive pins by retention means in a state wherein the plurality of conductive pins are slid away from the opposite electrode; a conductive pin release step of releasing the plurality of conductive pins from retention in a state in which the electrode plate is fixedly set in position relative to the object; and a conductive pin contact step of sliding the plurality of conductive pins axially toward the object to bring tips of the plurality of conductive pins into contact with a surface of the object, after which voltage is applied across both electrodes to electrically heat the object, thereby to solve the problems mentioned above.

Effects of the Invention

According to the heating device as set forth in item 1 and the heating method as set forth in item 4 of the present invention, when bringing conductive pins into contact with an object, the plurality of conductive pins are released from retention so that they can axially slide and follow an irregular contour of the object. Therefore, an irregularly shaped object can be evenly and efficiently heated, as the conductive pins smoothly slide inside the through holes and sufficiently follow the irregular shape of the object.

As the conductive pins are subjected to no forces in other directions than their sliding directions, the conductive pins are unlikely to be bent or broken, and also the object such as a food product is unlikely to be scarred or crushed.

According to the configuration as set forth in item 2, the plurality of conductive pins can be retained readily in a state in which the conductive pins are slid away from the opposite electrode, only by an operation of pushing in the tips of the plurality of conductive pins, as the rear ends of the conductive pins are attracted to the magnetic plate.

According to the configuration as set forth in item 3, the thickness of the non-magnetic plate may be adjusted in accordance with the arrangement of electrodes, or weight and shape of the conductive pins to achieve an optimal level of attractive force, and the pins can be released from retention reliably only by a small movement of the non-magnetic plate separating from the magnetic plate.

EXPLANATION OF REFERENCE NUMERALS

Figure 1:
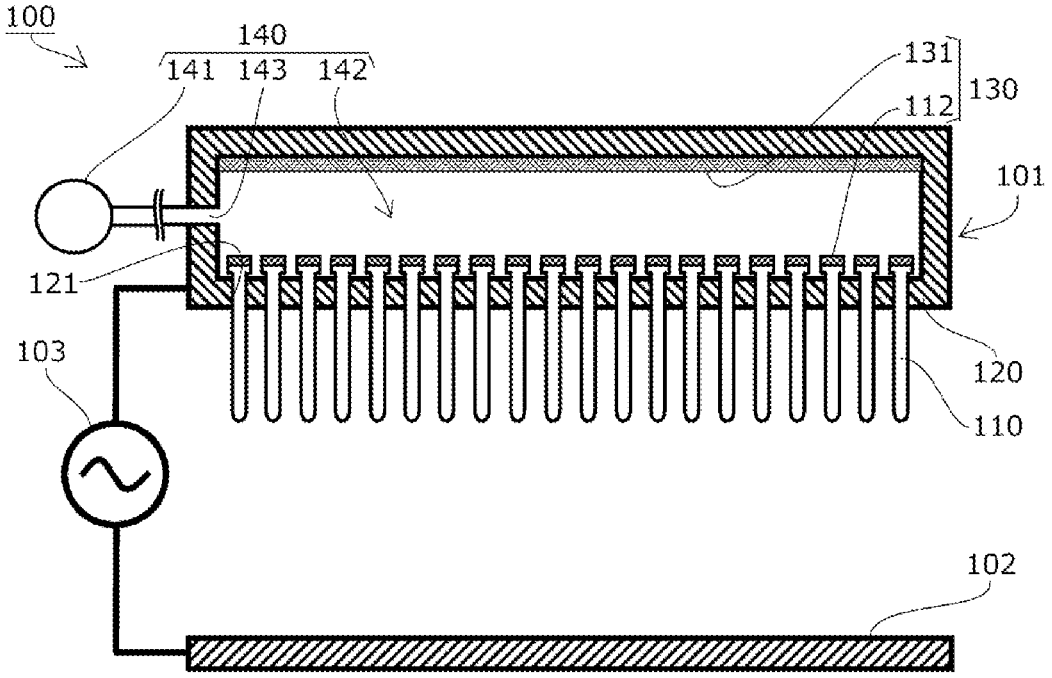
FIG. 1 is a schematic diagram of a heating device according to Embodiment 1 of the present invention.

100, 200, 300, 400, 500: Heating device
101, 201, 301, 401, 501: Upper electrode
110, 210, 310, 410, 510: Conductive pin
111, 311, 511: Tip
112, 212: Magnet sheet
113: Stepped portion
313: Rivet
120, 220, 320, 420, 520: Electrode plate
121, 221, 321, 421, 521: Through hole
422: Electrode support plate
130: Retention means
131, 231: Steel plate
232: Through hole
333: Magnet sheet
434: Magnetic plate
435: Stopper pin through hole
140: Release means
141: Pump
142, 242, 342: Chamber
143, 243, 343: Air supply hole
144, 244, 344, 444: Non-magnetic plate
445: Support bar
446: Pressure spring
447: Restriction plate
448: Restriction plate switch means
449: Stopper pin
M: Object

MODES FOR CARRYING OUT THE INVENTION

The heating device of the present invention may be embodied in any specific forms as long as it is a heating device for electrically heating an object by placing the object between electrodes that are arranged opposite each other, at least one of the electrodes having an electrode plate with a plurality of through holes and a plurality of conductive pins axially slidably supported in the through holes, the at least one of the electrodes including retention means that retain the plurality of conductive pins supported in the electrode plate in a state in which the conductive pins are slid away from an opposite electrode, and release means that release the plurality of conductive pins from retention by the retention means, whereby an irregularly shaped object can be evenly and efficiently heated with a plurality of conductive pins smoothly sliding inside through holes so that their tips can sufficiently follow the irregular shape of the object, while damage to the conductive pins or the object is prevented.

The heating method of the present invention may be embodied in any specific forms as long as it is a heating method that uses a heating device for electrically heating an object by placing the object between electrodes that are arranged opposite each other, at least one of the electrodes having an electrode plate with a plurality of through holes and a plurality of conductive pins axially slidably supported in the through holes, including: a conductive pin retraction step of sliding the plurality of conductive pins supported in the electrode plate away from an opposite electrode; a conductive pin retention step of retaining the conductive pins with retention means in a state wherein the plurality of conductive pins are slid away from the opposite electrode; a conductive pin release step of releasing the plurality of conductive pins from retention in a state in which the electrode plate is fixedly set in position relative to the object; and a conductive pin contact step of sliding the plurality of conductive pins axially toward the object to bring tips of the plurality of conductive pins into contact with a surface of the object, after which voltage is applied across both electrodes to electrically heat the object, whereby an irregularly shaped object can be evenly and efficiently heated with a plurality of conductive pins smoothly sliding inside through holes so that their tips can sufficiently follow the irregular shape of the object, while damage to the conductive pins or the object is prevented.

Embodiment 1

A heating device 100 according to Embodiment 1 of the present invention is configured to have a lower electrode 102 and an upper electrode 101 that are conductive sheet-like members disposed opposite each other, as shown in FIG. 1, with a power supply 103 for applying a high frequency electric field across both electrodes.

The lower electrode 102 is formed by a conductive member in the form of a flat plate so that an object to be heated can be placed thereon.

The upper electrode 101 includes an electrode plate 120 having a plurality of through holes 121, and a plurality of conductive pins 110 axially slidably supported in these through holes 121. A chamber 142 is formed above the electrode plate 120 such that all the through holes 121 face the interior of the chamber 142.

The chamber 142 is configured such that pressure inside can be changed or adjusted by supplying or exhausting air through an air supply hole 143 by means of a pump 141.

Figure 2:
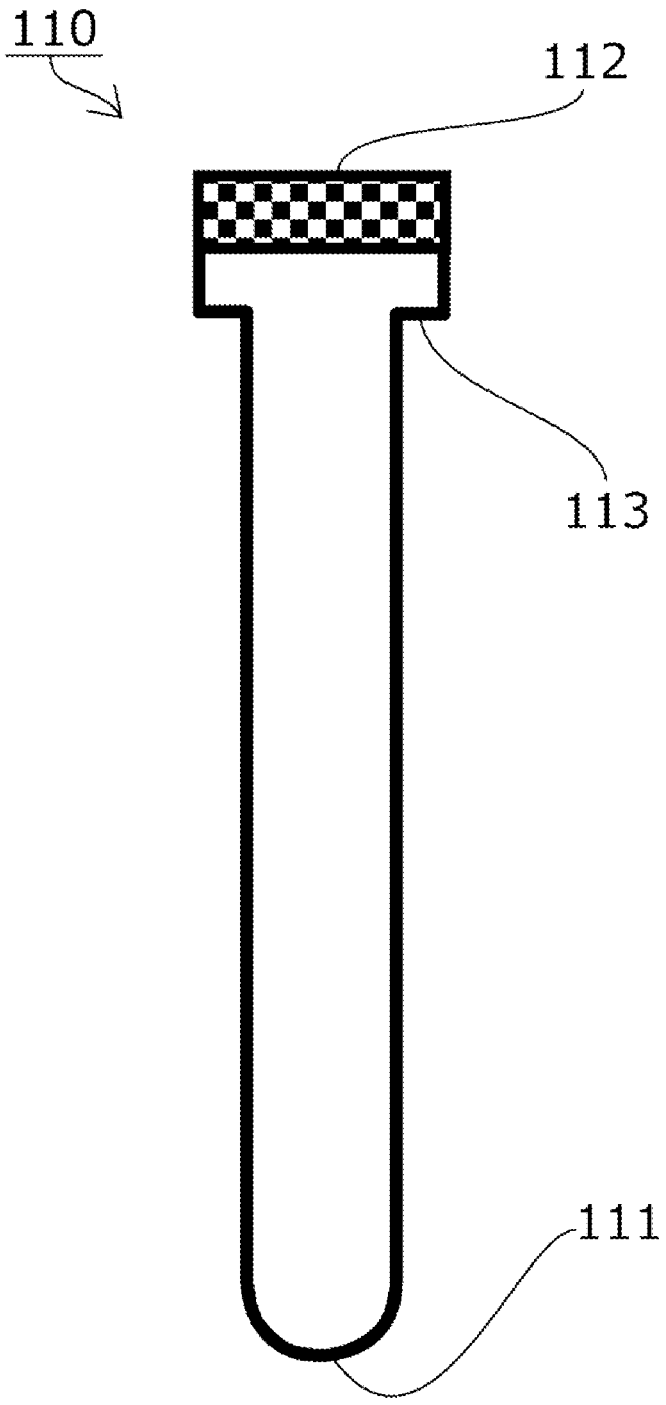
FIG. 2 is a schematic diagram of a conductive pin of the heating device according to Embodiment 1 of the present invention.

The conductive pin 110 has a stepped portion 113 to be able to engage with the through hole 121 on the opposite side from the tip 111 that will contact the object being heated, and a magnet sheet 112 on the rear end, as shown in FIG. 2.

Inside the chamber 142 on the further side from the lower electrode 102 is provided a steel plate 131 parallel to the electrode plate 120 to form retention means 130, whereby the conductive pins 110 are retained in a state in which they are slid away from the lower electrode 102, by the steel plate 131 and the magnet sheets 112 magnetically attracting each other.

Release means 140 for releasing the plurality of conductive pins 110 from retention by the retention means 130 are formed by the pump 141 that supplies air from the air supply hole 143 to raise pressure inside the chamber 142 thereby to apply a force to the conductive pins 110 to protrude toward the lower electrode 102.

The operation of the heating device 100 according to Embodiment 1 of the present invention configured as described above will be explained.

Figure 3:
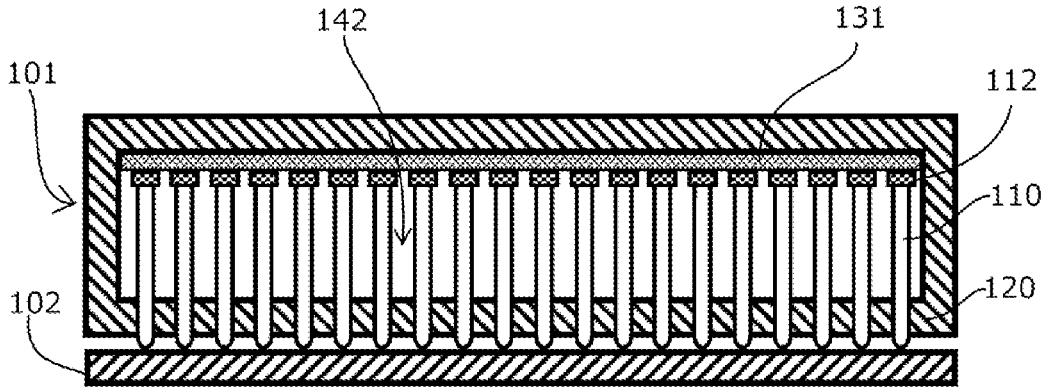
FIG. 3 is a diagram for explaining a state in which the conductive pins are retained in the heating device according to Embodiment 1 of the present invention.

First, the plurality of conductive pins 110 supported in the electrode plate 120 are slid away from the lower electrode 102 as shown in FIG. 3, i.e., pushed into the chamber 142 (conductive pin retraction step), so that the magnet sheets 112 of the conductive pins 110 are attracted by magnetic force and retained on the steel plate 131 (conductive pin retention step).

The conductive pins 110 are retained when the attractive magnetic force between the steel plate 131 and the magnet sheets 112 of the conductive pins 110 is larger than the gravity of the conductive pins 110, (i.e., gravity<attractive force).

This operation is performed by bringing the lower electrode 102 relatively closer to the electrode plate 120 in FIG. 3, which may be achieved either by lowering the electrode plate 120, or raising the lower electrode 102.

Alternatively, this may be achieved by using another flat plate-like member, or the operator may manually push in the plurality of conductive pins 110, or a negative pressure may be created by exhausting air from the chamber 142 through the air supply hole 143 by means of the pump 141 to pull the plurality of conductive pins 110 by suction into the chamber 142.

Figure 4:
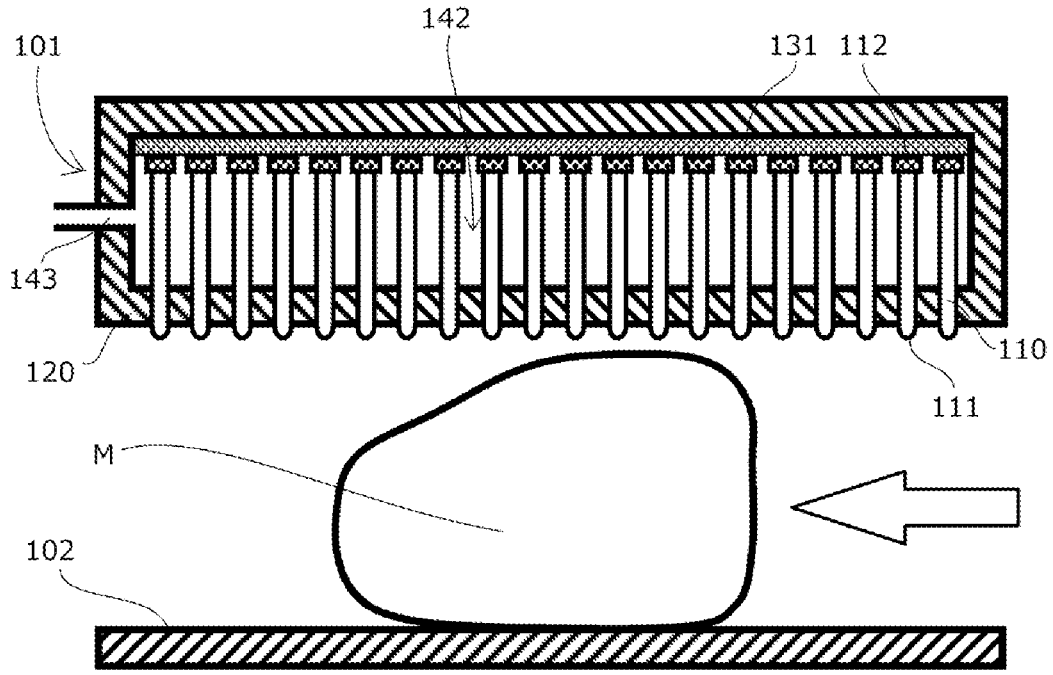
FIG. 4 is a diagram for explaining a state when an object is introduced into the heating device according to Embodiment 1 of the present invention.
Figure 5:
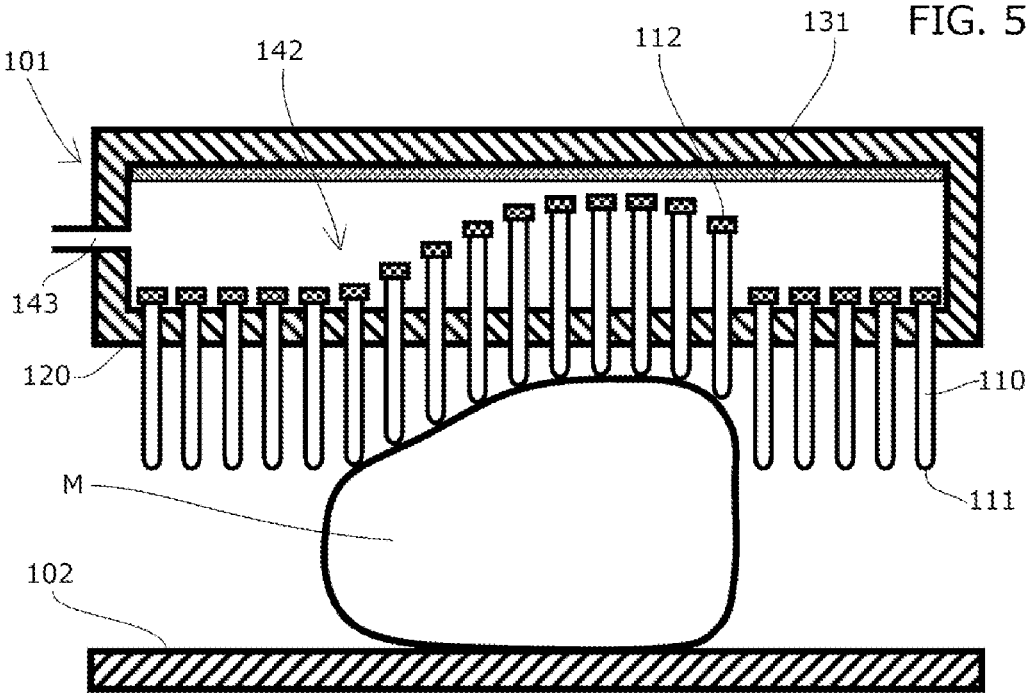
FIG. 5 is a diagram for explaining a state when the conductive pins are released from retention in the heating device according to Embodiment 1 of the present invention.

Next, an object M is introduced from one side, with sufficient space given between the lower electrode 102 and tips 111 of the plurality of conductive pins 110 retained or housed inside the chamber 142 as shown in FIG. 4 (object introduction step), and placed on the lower electrode 102. After that, the upper electrode 101 is brought sufficiently close to the object, and the plurality of conductive pins 110 are released from retention (conductive pin release step) so that the plurality of conductive pins 110 axially slide toward the object M and the tips 111 of the plurality of conductive pins 110 contact the object M such as to follow the surface of the object as shown in FIG. 5 (conductive pin contact step).

The plurality of conductive pins 110 are released from retention by supplying air into the chamber 142 from the air supply hole 143 to raise the pressure from the state of FIG. 4 to a level higher than outside to apply a force to the conductive pins 110 to protrude toward the lower electrode 102 (conductive pin release step).

Supplying air into the chamber 142 applies pressure on the attraction surfaces of the magnet sheets 112 of the conductive pins 110, and moreover, as the tips 111 of the conductive pins 110 are located outside the chamber 142 where pressure is lower, the pressure difference imparts a force on the conductive pins 110 to protrude toward the lower electrode 102.

The pins are released from retention when the sum of the protruding force caused by the pressure difference and the gravity of the conductive pins 110 overcomes the attractive magnetic force between the steel plate 131 and the magnet sheets 112 of the conductive pins 110, (i.e., (gravity+protruding force)>attractive force).

Once the conductive pins 110 are released from retention, the attractive magnetic force reduces quickly as the distance between the steel plate 131 and the magnet sheets 112 of the conductive pins 110 increases, so that the conductive pins 110 protrude quickly and smoothly almost only by the sum of the protruding force caused by the pressure difference and the gravity of the conductive pins 110, and the tips 111 of the conductive pins 110 contact the object M such as to follow the surface of the object as shown in FIG. 5.

The attraction surfaces of the steel plate 131 and the magnet sheets 112 of the conductive pins 110 are, microscopically, rough surfaces that do not inhibit entrance of air flow between the surfaces. Combined with possible slight deformation or vibration of the steel plate 131 when pressure is raised by supplying air into the chamber 142, the protruding force is generated swiftly by the pressure difference as soon as air is supplied into the chamber 142 to increase the pressure. Nevertheless, the surface of the steel plate 131, or the magnet sheets 112, may have irregularities or be slightly curved to facilitate entrance of air flow therebetween, to produce the protruding force even more swiftly to release the conductive pins 110 from retention.

In the state of FIG. 5, a high frequency electric field is applied across both lower electrode 102 and upper electrode 101 for induction heating, whereby even an irregularly shaped object M can be evenly heated in a short time without local concentration of heat, as the tips 111 of the plurality of conductive pins 110 evenly make contact with the surface of the object M.

Embodiment 2

Next, a heating device 200 according to Embodiment 2 of the present invention will be described.

Figure 6:
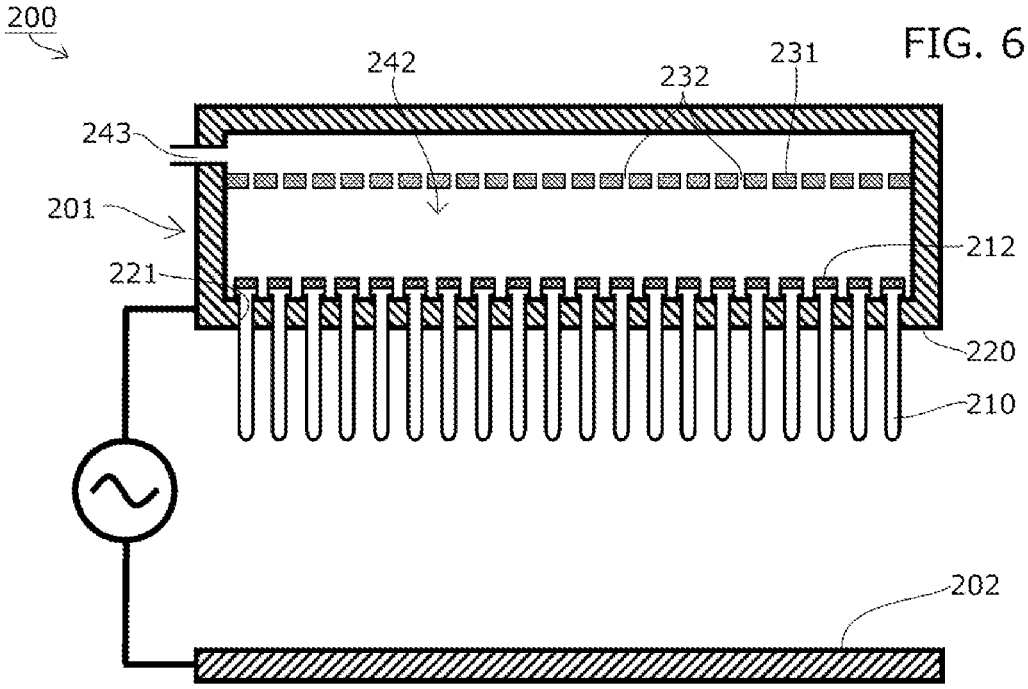
FIG. 6 is a schematic diagram of a heating device according to Embodiment 2 of the present invention.

The heating device 200 according to Embodiment 2 of the present invention is configured similarly to the heating device 100 according to Embodiment 1 except for the upper electrode 201, as shown in FIG. 6.

The upper electrode 201 includes an electrode plate 220 having a plurality of through holes 221, and a plurality of conductive pins 210 axially slidably supported in these through holes 221. A chamber 242 is formed above the electrode plate 220 such that all the through holes 221 face the interior of the chamber 242.

The chamber 242 is configured such that pressure inside can be changed or adjusted by supplying or exhausting air through an air supply hole 243 by means of a pump. The air supply hole 243 is located immediately below the surface on the side further from the lower electrode 202 inside the chamber 242.

Below the air supply hole 243 and away from the surface on the side further from the lower electrode 202 inside the chamber 242 is provided a steel plate 231 having a multiplicity of through holes 232 parallel to the electrode plate 220.

The chamber 242 is thus divided up and down by the steel plate 231, but as the multiplicity of through holes 232 allow free air flow, the pressure inside the chamber 242 is always even between upper and lower parts.

With this configuration, with the through holes 232 present in the attraction surface of the steel plate 231 contacting the magnet sheets 212 when the magnet sheets 212 of the conductive pins 210 are magnetically attracted and retained on the steel plate 231, air supplied from the air supply hole 243 when releasing the plurality of conductive pins 210 from retention (conductive pin release step) can directly flow onto the attraction surfaces of the magnet sheets 212, so that the protruding force is generated more quickly to release the conductive pins 210 from retention.

The steel plate 231 may have a mesh-like structure instead of the multiplicity of through holes 232.

Embodiment 3

Next, a heating device 300 according to Embodiment 3 of the present invention will be described.

Figure 7:
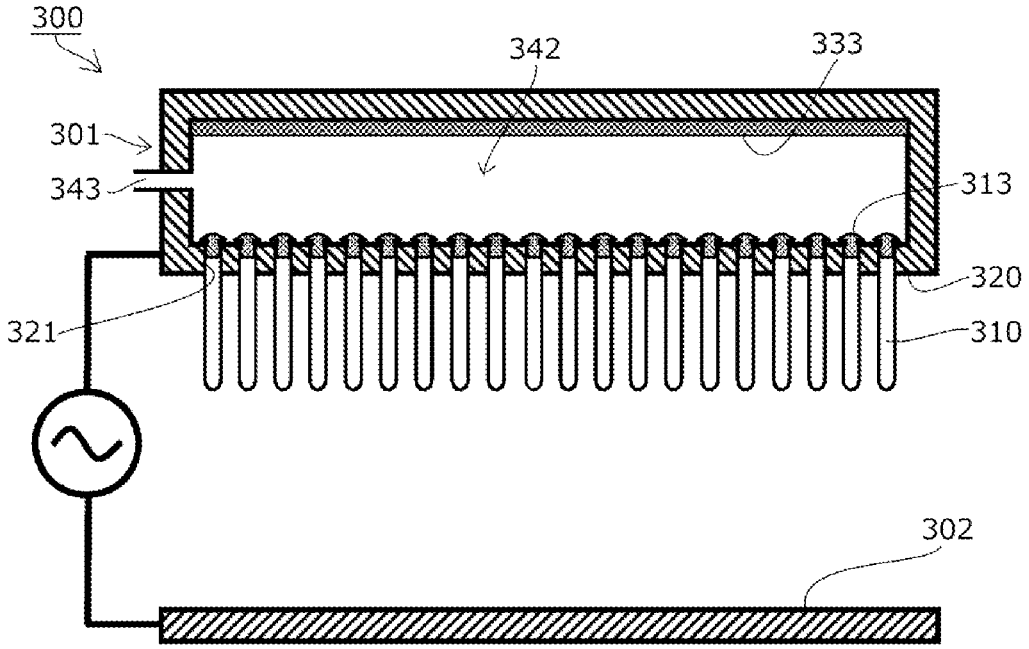
FIG. 7 is a schematic diagram of a heating device according to Embodiment 3 of the present invention.
Figure 8:
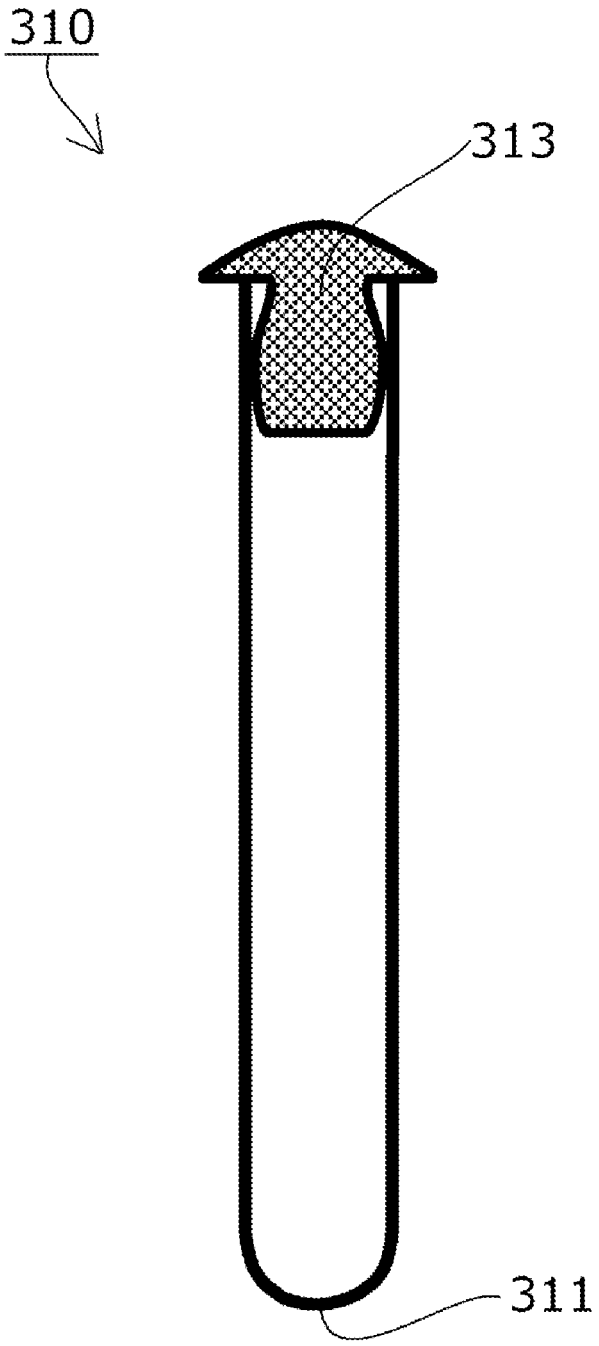
FIG. 8 is a schematic diagram of a conductive pin of the heating device according to Embodiment 3 of the present invention.

The heating device 300 according to Embodiment 3 of the present invention is configured similarly to the heating device 100 according to Embodiment 1 except for the upper electrode 301, as shown in FIG. 7 and FIG. 8.

The upper electrode 301 includes an electrode plate 320 having a plurality of through holes 321, and a plurality of conductive pins 310 axially slidably supported in these through holes 321. A chamber 342 is formed above the electrode plate 320 such that all the through holes 321 face the interior of the chamber 342.

The chamber 342 is configured such that pressure inside can be changed or adjusted by supplying or exhausting air through an air supply hole 343 by means of a pump.

The conductive pin 310 is formed by a hollow, lightweight non-magnetic metal member (e.g., aluminum) with a closed tip 311 that will contact the object as shown in FIG. 8. A solid, magnetic rivet 313 is pressed into the open rear end.

Inside the chamber 342 on the further side from the lower electrode 302 is provided a magnet sheet 333 parallel to the electrode plate 320 so that the magnet sheet 333 and the rivets 313 attract each other by magnetic force to retain the conductive pins 310 slid away from the lower electrode 302.

With this configuration, the conductive pins 310 can be made very lightweight and moved more smoothly, which also leads to a weight reduction of the entire heating device 300.

Embodiment 4

Next, a heating device according to other embodiments of the present invention will be described.

Figure 9:
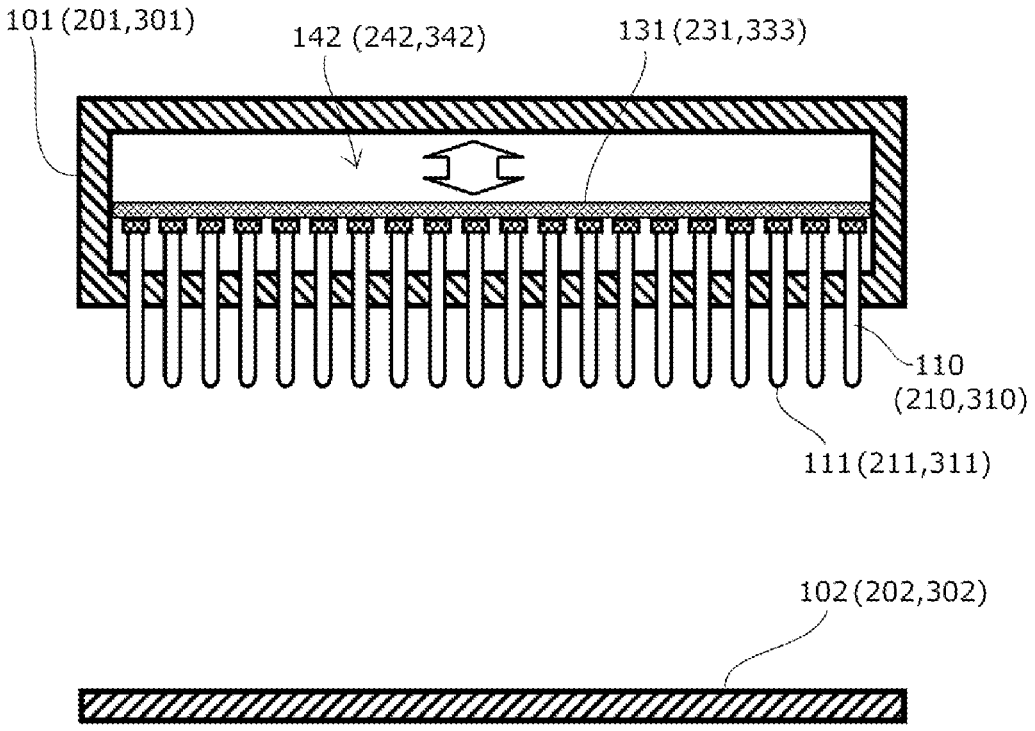
FIG. 9 is a diagram for explaining a state in which the conductive pins are retained in the heating device according to another embodiment of the present invention.

In the device shown in FIG. 9, the steel plate 131 or 231, or the magnet sheet 333, provided inside the chamber 142, 242, or 342 of the heating device 100, 200, or 300 of various embodiments described above, is movable in up and down directions inside the chamber 142, 242, or 342.

The steel plate 131 or 231, or the magnet sheet 333, is lowered to magnetically attract the conductive pins 110, 210, or 310, after which it is lifted up (conductive pin retraction step) to retain the conductive pins away from the lower electrode 102, 202, or 302 (conductive pin retention step).

Because of this configuration, the upper electrode 101, 201, or 301, or lower electrode 102, 202, or 302 need not be moved, and the tips 111, 211, or 311 of the plurality of conductive pins 110, 210, or 310 need not be pushed in, to retract and retain the conductive pins.

Figure 10:
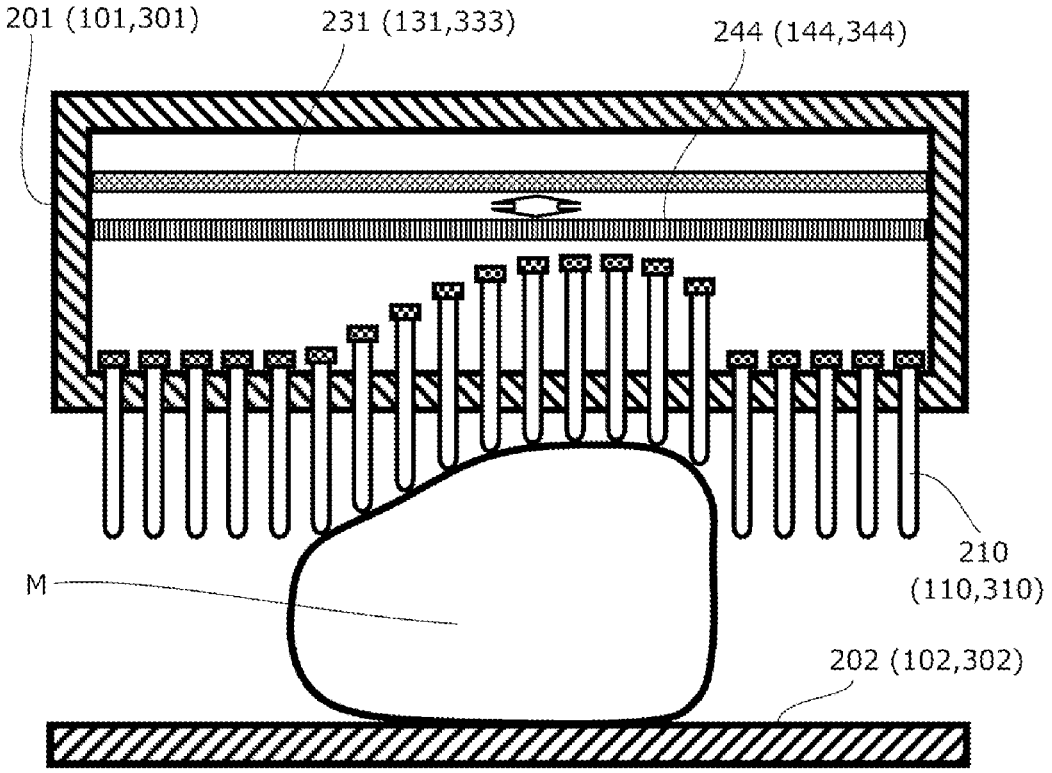
FIG. 10 is a diagram for explaining a state when the conductive pins are released in the heating device according to another embodiment of the present invention.
Figure 11:
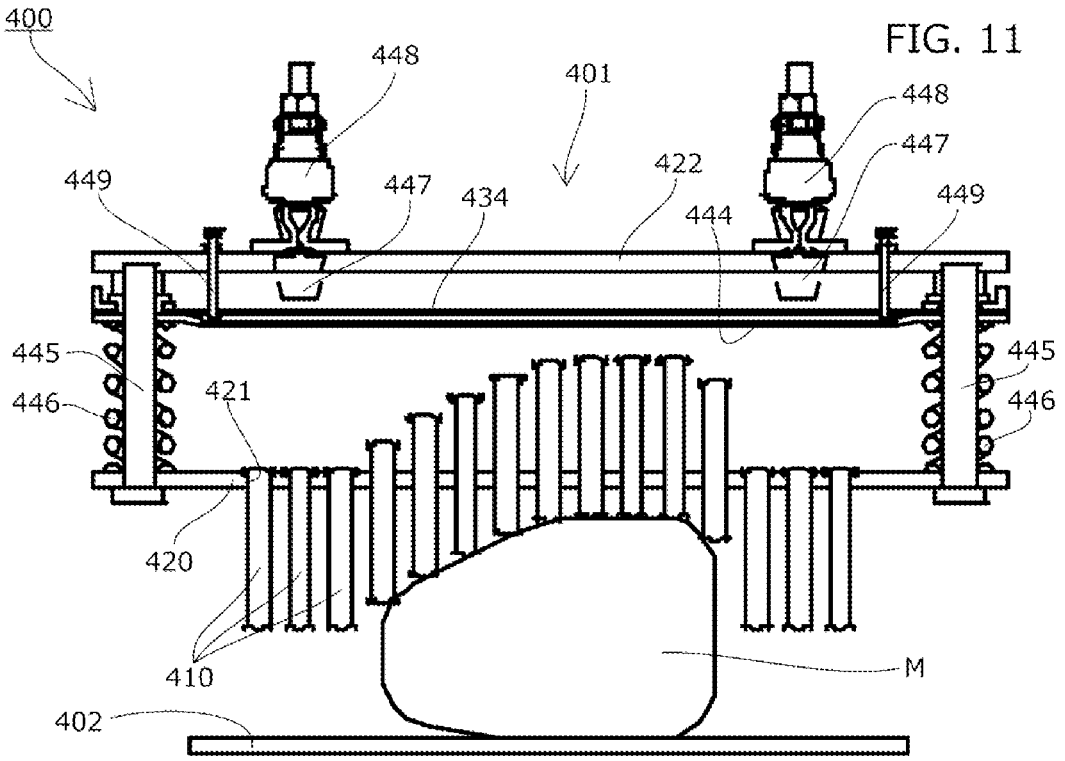
FIG. 11 is a schematic diagram of a heating device according to Embodiment 4 of the present invention.

In the device shown in FIG. 10, a non-magnetic plate 144, 244, or 344 is arranged immediately below the steel plate 131 or 231, or the magnet sheet 333, inside the chamber 142, 242, or 342 of the heating device 100, 200, or 300 of various embodiments described above, such as to be movable relative to the steel plate 131 or 231, or the magnet sheet 333, to contact it parallel thereto or move away therefrom.

When retained, the plurality of conductive pins 110, 210, or 310 are magnetically attracted to the steel plate 131 or 231, or the magnet sheet 333, via the non-magnetic plate 144, 244, 344 making contact with the steel plate or magnet sheet.

To release the plurality of conductive pins 110, 210, or 310 from retention (conductive pin release step), the non-magnetic plate 144, 244, 344 and the steel plate 131 or 231, or the magnet sheet 333, are moved relatively away from each other to reduce the magnetic force, so that the plurality of conductive pins 110, 210, or 310 slide toward the object M by gravity and the tips 111, 211, or 311 of the plurality of conductive pins 110, 210, or 310 contact the object M such as to follow the surface of the object (conductive pin contact step).

The thickness of this non-magnetic plate 144, 244, 344 may be set as required, or the distance between it and the steel plate 131 or 231, or the magnet sheet 333, when retaining the pins may be adjusted, to achieve an optimal level of attractive force. Thus retention or release of the conductive pins 110, 210, or 310 by the steel plate 131 or 231, or the magnet sheet 333, can be performed readily and reliably.

Embodiment 5

Next, a heating device 400 according to Embodiment 4 of the present invention will be described.

A heating device 400 according to Embodiment 4 of the present invention has a lower electrode 402 and an upper electrode 401 that are conductive sheet-like members disposed opposite each other as shown in FIG. 11 to FIG. 14. The device is configured similarly to other embodiments in that a high frequency electric field is applied across both electrodes.

The upper electrode 401 includes an electrode support plate 422 provided above the electrode plate 420 to support it via support bars 445.

The electrode plate 420 includes a plurality of through holes 421 as with other embodiments, and a plurality of conductive pins 410 that are supported axially slidably in the through holes 421.

Between the electrode plate 420 and the electrode support plate 422 are provided a magnetic plate 434 and a non-magnetic plate 444 such as to be guided and slidable along the support bars 445.

The non-magnetic plate 444 is arranged on the side closer to the electrode plate 420 and pressed by a pressure spring 446 so that the magnetic plate 434 and non-magnetic plate 444 integrally move toward the electrode support plate 422.

The conductive pins 410 each have a magnetic member at the open rear end as with other embodiments so that they are magnetically attracted to the magnetic plate 434 via the non-magnetic plate 444 integral with the former.

It may be defined arbitrary that either the magnetic plate 434 or the rear ends of the conductive pins 410 is to be made of a paramagnetic material such as a magnet.

The electrode support plate 422 is provided with restriction plates 447 that can restrict movement of the magnetic plate 434 and non-magnetic plate 444 toward the electrode support plate 422. The restriction plates 447 are configured to be switchable between a restricting position and a non-restricting position by means of restriction plate switch means 448.

The electrode support plate 422 is provided with stopper pins 449 protruding toward the magnetic plate 434, and the magnetic plate 434 has stopper pin through holes 435 at positions opposite the stopper pins 449.

Figure 12:
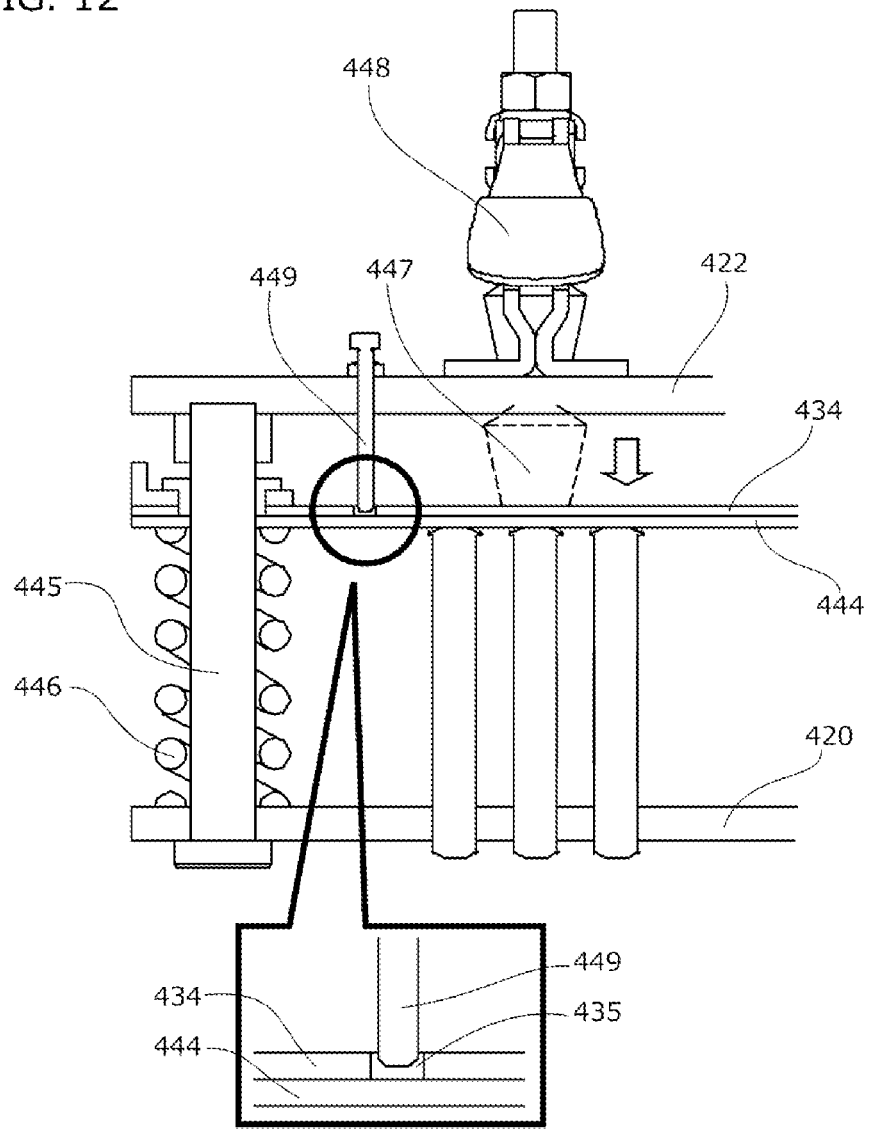
FIG. 12 is a diagram for explaining a state in which the conductive pins are retained in the heating device according to Embodiment 4 of the present invention.

The stopper pins 449 do not reach the non-magnetic plate 444 when the magnetic plate 434 and non-magnetic plate 444 are restricted by the restriction plates 447 from moving toward the electrode support plate 422, as shown in FIG. 12.

Figure 13:
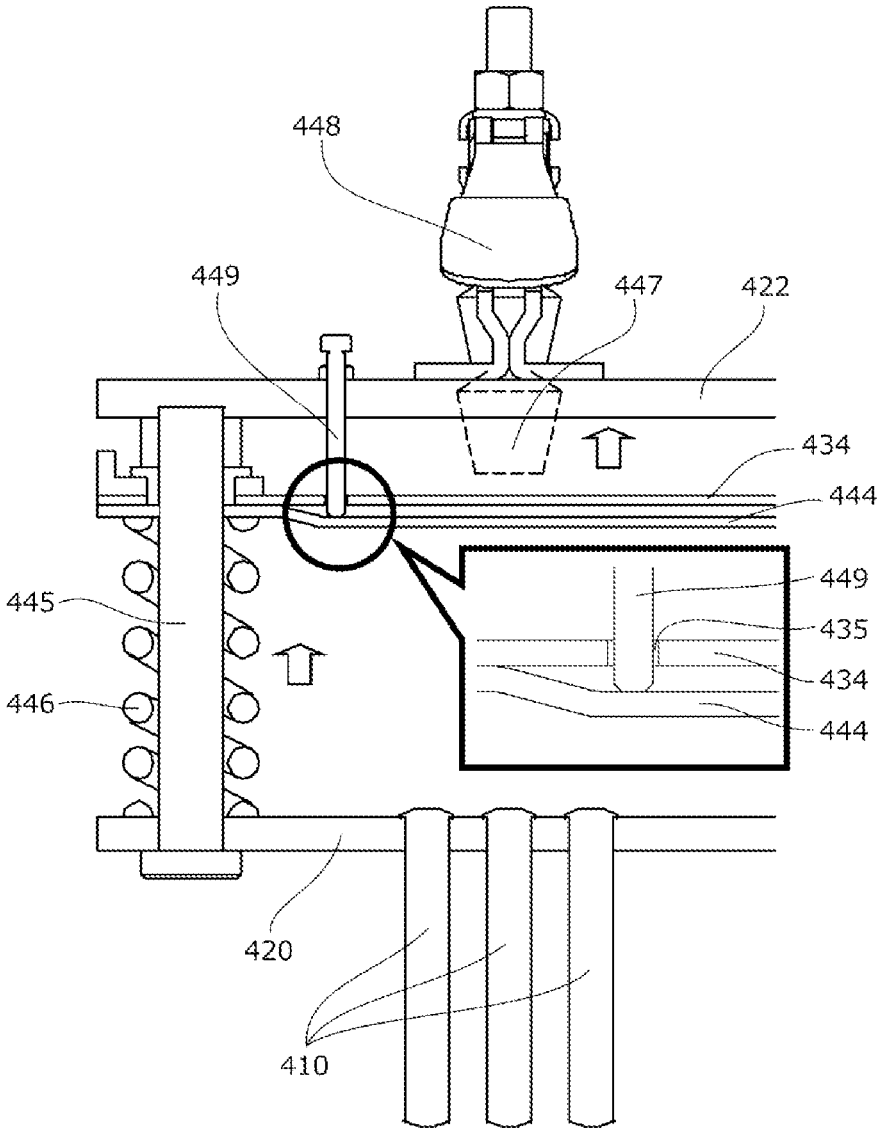
FIG. 13 is a diagram for explaining a state when the conductive pins are released in the heating device according to Embodiment 4 of the present invention.
Figure 14:
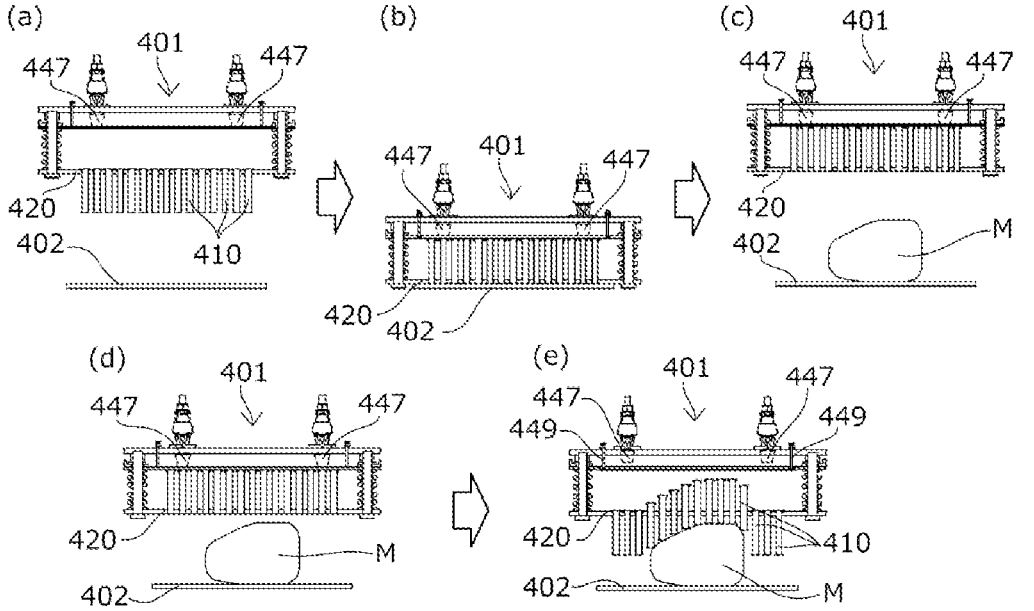
FIG. 14 is a diagram for explaining the operation of the heating device according to Embodiment 4 of the present invention.
Figure 15:
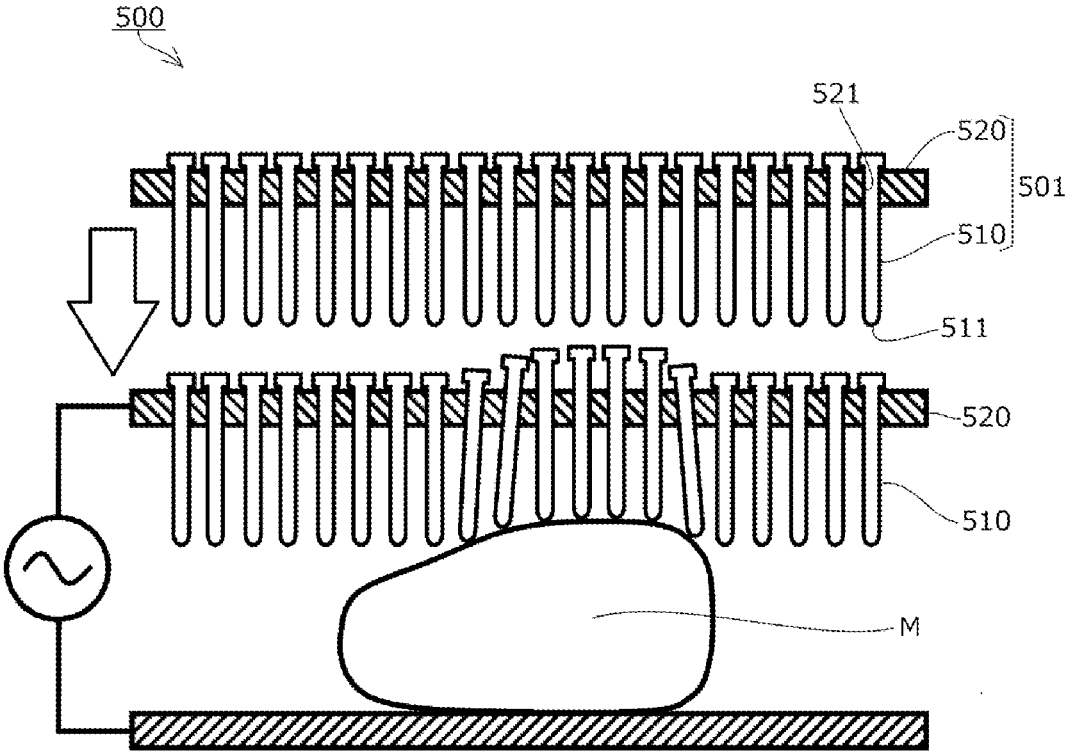
FIG. 15 Related Art
FIG. 15 is a schematic diagram of a conventional heating device.
Figure 16:
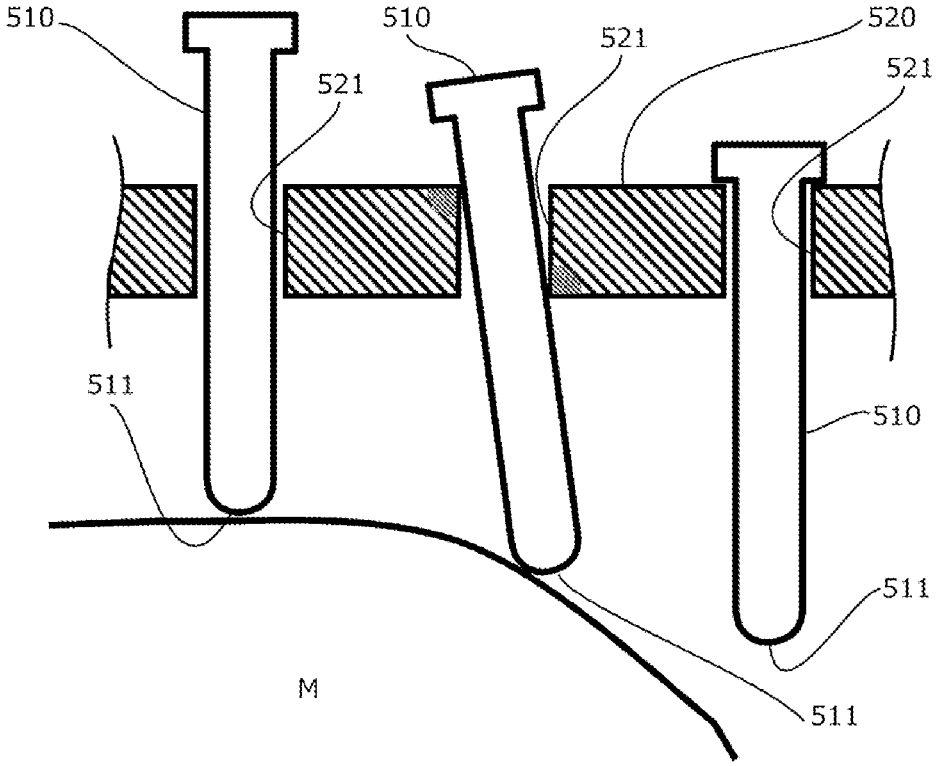
FIG. 16 Related Art
FIG. 16 is an enlarged view of part of FIG. 15.

When the restriction plates 447 are switched to the non-restricting position, and the magnetic plate 434 and non-magnetic plate 444 have further moved toward the electrode support plate 422, the stopper pins 449 restrict upward movement of the non-magnetic plate 444, as shown in FIG. 13.

Namely, when the restriction plates 447 are switched to the non-restricting position, there is a gap between the magnetic plate 434 and the non-magnetic plate 444, so that the conductive pins 410 attached to the magnetic plate 434 via the non-magnetic plate 444 are released from the magnetic attraction and separate therefrom by gravity.

In the embodiment shown in FIG. 13, the non-magnetic plate 444 is configured to warp. Alternatively, the non-magnetic plate 444 may be configured to separate from the magnetic plate entirely parallel thereto, by suitably designing the guiding of the magnetic plate 434 and non-magnetic plate 444 by means of the support bars 445 and their positions when pressed by the pressure spring 446.

The restriction plate switch means 448 may be of any mechanism as long as it can switch the positions of the restriction plates 447, and its drive source may be of any form, including by hand.

The position or number of the stopper pins 449 should not be limited to the one shown and may be designed suitably in accordance with the needs.

The operation of the heating device 400 according to Embodiment 4 of the present invention configured as described above will be explained.

First, with the restriction plates 447 set in the restricting position, the upper electrode 401 is moved toward the lower electrode 402, as shown in FIG. 14A.

When the upper electrode 401 moves to a position shown in FIG. 14B, all the conductive pins 410 are attracted to the magnetic plate 434 via the non-magnetic plate 444 (conductive pin retraction step). The upper electrode 401 is then moved away from the lower electrode 402 (conductive pin retention step).

The upper electrode 401, with the plurality of conductive pins 110 magnetically attracted therein, moves to a position shown in FIG. 14C, and an object M is introduced between the upper electrode 401 and the lower electrode 402 (object introduction step).

Next, as shown in FIG. 14D, the upper electrode 401 is brought sufficiently close to the object, and the restriction plates 447 are switched to the non-restricting position, whereby, as shown in FIG. 14E, the plurality of conductive pins 410 are released from retention (conductive pin release step) so that the plurality of conductive pins 410 axially slide toward the object M and their tips contact the object M such as to follow the surface of the object (conductive pin contact step).

In this state, a high frequency electric field is applied across both lower electrode 402 and upper electrode 401 for induction heating, whereby even an irregularly shaped object M can be evenly heated in a short time without local concentration of heat, as the tips of the plurality of conductive pins 410 evenly make contact with the surface of the object M.

While the upper electrode 401 is moved in the operation described above, the lower electrode 402 may be raised instead, or both electrodes may be moved, as long as the upper electrode 401 and the lower electrode 402 come closer relative to each other.

INDUSTRIAL APPLICABILITY

The heating device and heating method of the present invention may be applied suitably particularly for the heating of irregularly shaped food materials.

While the electrodes face each other up and down and the upper electrode only has conductive pins in the embodiments described above, the lower electrode may also have conductive pins that protrude upward. Also, two electrodes may be arranged to face each other in a horizontal direction, with one or both of the electrodes having conductive pins protruding horizontally.

In this case, as the conductive pins protrude in a different direction from that of gravity, a biasing force corresponding to the gravity applied to the pins in the upper electrode in the above embodiments may be given by means of a spring or the like, or, in the embodiments where a chamber is provided, such a force may be given by increasing pressure inside the chamber.

The invention claimed is:

1. A heating device for electrically heating an object by placing the object between electrodes, comprising:

electrodes that are arranged opposite each other, at least one of the electrodes having an electrode plate with a plurality of through holes and a plurality of conductive pins axially slidably supported in the through holes, said at least one of the electrodes including:

a retention plate which is movable in up and down directions for retaining rear ends of the plurality of conductive pins supported in said electrode plate in a state in which the conductive pins are slid away from an opposite electrode; and release means for releasing the plurality of conductive pins from retention by the retention plate.

2. The heating device according to claim 1, wherein rear ends of said conductive pins are formed by a magnetic member, and said retention plate includes a magnetic plate that is arranged parallel to said electrode plate and exerts an attractive magnetic force on the rear ends of said conductive pins.

3. The heating device according to claim 2, further comprising a non-magnetic plate between the rear ends of said conductive pins and said magnetic plate, wherein said release means include a mechanism for separating the non-magnetic plate from the magnetic plate.

4. A heating method that uses a heating device for electrically heating an object by placing the object between electrodes that are arranged opposite each other, at least one of the electrodes having an electrode plate with a plurality of through holes and a plurality of conductive pins axially slidably supported in the through holes, the method comprising:

a conductive pin retraction step of sliding the plurality of conductive pins supported in said electrode plate away from an opposite electrode by the vertical movement of a retention plate;

a conductive pin retention step of retaining rear ends of the conductive pins by the retention plate in a state in which said plurality of conductive pins are slid away from the opposite electrode;

a conductive pin release step of releasing said plurality of conductive pins from retention in a state in which said electrode plate is fixedly set in position relative to said object; and a conductive pin contact step of sliding said plurality of conductive pins axially toward the object to bring tips of the plurality of conductive pins into contact with a surface of the object, after which voltage is applied across both electrodes to electrically heat the object.

* * * * *